United States Patent [19]

Chen

[11] Patent Number: 4,598,662

[45] Date of Patent: Jul. 8, 1986

[54] DRUM COAGULATOR FOR PREPARING MICROPOROUS MEMBRANES

[75] Inventor: William K. W. Chen, Berkeley Heights, N.J.

[73] Assignee: International Microporous Technology, Inc., Sunnyvale, Calif.

[21] Appl. No.: 465,768

[22] Filed: Feb. 11, 1983

[51] Int. Cl.[4] ..... B05C 11/00; B05C 11/02; B05C 3/12

[52] U.S. Cl. ..... 118/34; 29/121.1; 118/118; 118/419; 118/420; 210/500.42; 427/173; 427/176; 427/245

[58] Field of Search ..... 118/264, 246, 252, 244, 118/419, 420, 118, 33, 34; 29/120, 121.1, 121.3, 129.5; 427/289, 299, 300, 389.9, 428, 434.4, 173, 176, 245; 210/500.2

[56] References Cited

U.S. PATENT DOCUMENTS

| | | | |
|---|---|---|---|
| 1,915,128 | 6/1933 | Keltie | 29/121.1 |
| 3,449,156 | 6/1969 | Brown | 118/419 X |
| 3,642,668 | 2/1972 | Bailey et al. | 264/299 X |
| 3,808,033 | 4/1974 | Mayhew | 118/419 X |
| 3,829,360 | 8/1974 | Holz | 29/121.3 X |
| 3,912,834 | 10/1975 | Imai et al. | 427/316 |
| 4,052,521 | 10/1977 | Ferrari | 118/34 X |
| 4,193,178 | 3/1980 | McArthur et al. | 29/129.5 |
| 4,194,041 | 3/1980 | Gore et al. | 428/315 |
| 4,203,848 | 5/1980 | Grandine, III | 210/490 |

*Primary Examiner*—Michael R. Lusignan
*Attorney, Agent, or Firm*—Malcolm B. Wittenberg

[57] ABSTRACT

A process and device for producing a flexible layered article suitable for use in water proof garments wherein one of said layers is a microporous membrane material produced from the "solvent non-solvent" method wherein a fabric backing coated with the membrane material dissolved in a solvent is contacted with a drum having gripping means offering substantial resistance to the natural tendency of the coated fabric to curl when immersed in a non-solvent for the polymer material.

14 Claims, 7 Drawing Figures

DRUM COAGULATOR FOR PREPARING MICROPOROUS MEMBRANES

TECHNICAL FIELD

It has been well known for quite some time that a waterproof garment can be prepared which is "breathable" by providing the garment with a microporous membrane which provides for the transmission of water vapor but is hydrophobic and thus does not provide for the passage of liquid water. For water resistant sportswear and camping gear, these membranes are usually laminated to fabrics for mechanical protection and style. The membranes are inherently hydrophobic and contain very small pores that resist the entry of liquid water even under substantial pressure or when rubbed or flexed, but readily allow the flow of gases, including water vapor. Unlike wicking materials, breathability is achieved by evaporation of water and water vapor inside the garment or around the inner surface of the membrane followed by gaseous flow or diffusion of water vapor through the membrane to the outside. The manufacturer of such garments is disclosed in U.S. Pat. No. 4,194,041, the disclosure of which is incorporated herein by reference.

Microporous membranes such as those described above, have also been used in distillation apparatus and for molecular filtration. One of the basic processes used in preparation of microporous films involves the mixture of a solvent solution of the film forming material with a liquid, which is a non-solvent for the material and is miscible with the solvent, and forming the mixture into a film. The process is denoted the "solvent-non-solvent" process for forming microporous films. Many variations of the basic process are also known such as those shown in U.S. Pat. Nos. 1,421,341; 3,100,721 and 3,208,875.

When a polymeric material is dissolved in a solvent and cast, it coalesces to form a film. In the "solvent-non-solvent" process, the film-forming material dissolved in a solvent is contacted with a non-solvent, which is miscible with the solvent. Subsequent to the casting of the polymer solution into a wet film, the solvent is replaced by the non-solvent, resulting in formation of a porous polymeric matrix.

U.S. Pat. No. 4,203,848 discloses making microporous membranes into molecular filtration membranes from vinylidene fluoride polymers. The patent goes on to teach a continuous process for producing such membranes which includes applying a layer of the solution of polyvinylidene fluoride polymer to the rigid moving support surface of a backing belt to form a film. This is followed by passing the belt through a formation bath in which the membrane is formed and subsequently removed therefrom. In the manufacture of waterproof garments, it is at times preferable to cast the membrane forming solution onto a fabric backing which becomes part of the waterproof garment for added strength. When the fabric-backed polymer solution is contacted with the non-solvent using apparatus taught in U.S. Pat. No. 4,203,848, it has been found that shrinkage occurs in the porous membrane but not in the fabric during membrane formation, thus resulting in a layered structure which is wrinkled and which takes on a concave shape curled toward the membrane side of the structure. As such, the apparatus disclosed in U.S. Pat. No. 4,203,848 is incapable of producing a commercially viable fabric backed membrane without additional treatment and resulting expense.

Applicant's preferred polymer casting material comprises substantially polyvinylidene fluoride in a solution of dimethylacetamide, although dimethylformamide, methyl acetone, methyl ethyl keytone and mixtures of the same are useful solvents for the polymer. The solution is coated on a base fabric which is then contacted with water which can contain up to 40% dimethylacetamide, which is miscible with the solvent but which is a non-solvent for the polymer. As stated previously, it was found that as water continuously diffuses into the matrix replacing the solvent, there is a noticeable degree of dimensional shrinkage of the coagulated microporous membrane vis à the fabric causing the coated fabric to curl concaving towards the membrane side.

In an actual continuous coating process, the shrinkage of the membrane relative to the base fabric will not only cause a permanent tendency of the final article to curl, but could also cause creases to form in the coated fabric and thus result in a material that could not be commercialized. This could be avoided if the fabric is held at its edges thus mechanically restraining the fabric during the coagulation and subsequent drying process. Commercially, tenter-frames are used to hold fabric edges while riding on guide rails. These tenter-frames are commonly used in the tensioned-drying of fabric but if such tenter-frames are used in the coagulation bath disclosed in U.S. Pat. No. 4,203,848, the required length of the structure will result in an extremely expensive capital equipment investment. Although festooning of the fabric in the coagulation-solidification wash tank would reduce the total tank length, the snake-like configuration of guide rails and tenter chain drives needed to carry out the festooning operation are also expensive. In the case of the use of dimethylacetamide as the solvent for a polyvinylidene fluoride polymer, the solvent will most certainly dissolve grease needed in lubricated bearings in a festooning operation, which must be substituted by Teflon sliding surfaces. The higher friction, in turn, increases the need for driving the chains at more frequent intervals so that the overall result of festooning tenter frames running into a coagulation-solidification wash tank system becomes exorbitantly expensive and difficult to maintain.

It is thus an object of the present invention to teach a process and device to produce an improved flexible layered article suitable for use as a waterproof and breathable fabric containing a microporous membrane without the drawbacks of the prior art.

It is yet another object of the present invention to teach a process and device to produce such a flexible layered article which exhibits little or no curl in the final product.

These and other objects of this invention will be more fully understood and appreciated when considering the following disclosure and drawings wherein:

FIG. 1 is a plan view of a device for carrying out the process of the present invention.

FIG. 2 is a plan view of one embodiment of the process of the present invention for maintaining gripping contacts between fabric coated with polymer solution and the processing drum.

FIG. 3 is a sectional view showing the details of the gripping means of FIG. 2.

FIGS. 4–6 are various prospective drawings of alternative gripping means for maintaining contact between the fabric coated with polymer solution and the processing drum.

FIG. 4*a* is a cross-sectional view of the device depicted in FIG. 4.

FIG. 7 is a prospective drawing of a porous drum, a preferred embodiment of the present invention.

DISCLOSURE OF INVENTION

The present invention involves a process and device for producing a flexible layered article suitable for use in waterproof garments which permits the transfer of water vapor but is resistant to transmission of liquid water. The layered article more specifically comprises a flexible first layer of hydrophobic microporous membrane material adhered to a fabric backing. The microporous membrane material is produced by coating a solution of a polymeric material dissolved in a solvent on a fabric backing followed by immersing the coated fabric backing in a nonsolvent for the polymer but which is miscible with the solvent.

The fabric backing coated with the polymeric material dissolved in the solvent is contacted with a drum having gripping means and a surface curvature which substantially resists the natural tendency of the coated fabric to curl when immersed in the non-solvent. It is intended that the gripping means substantially prevents width shrinkage and prevents relative movement between the fabric backing and drum surface while the fabric backing is in contact with the drum while being immersed within the non-solvent.

Figure 1:
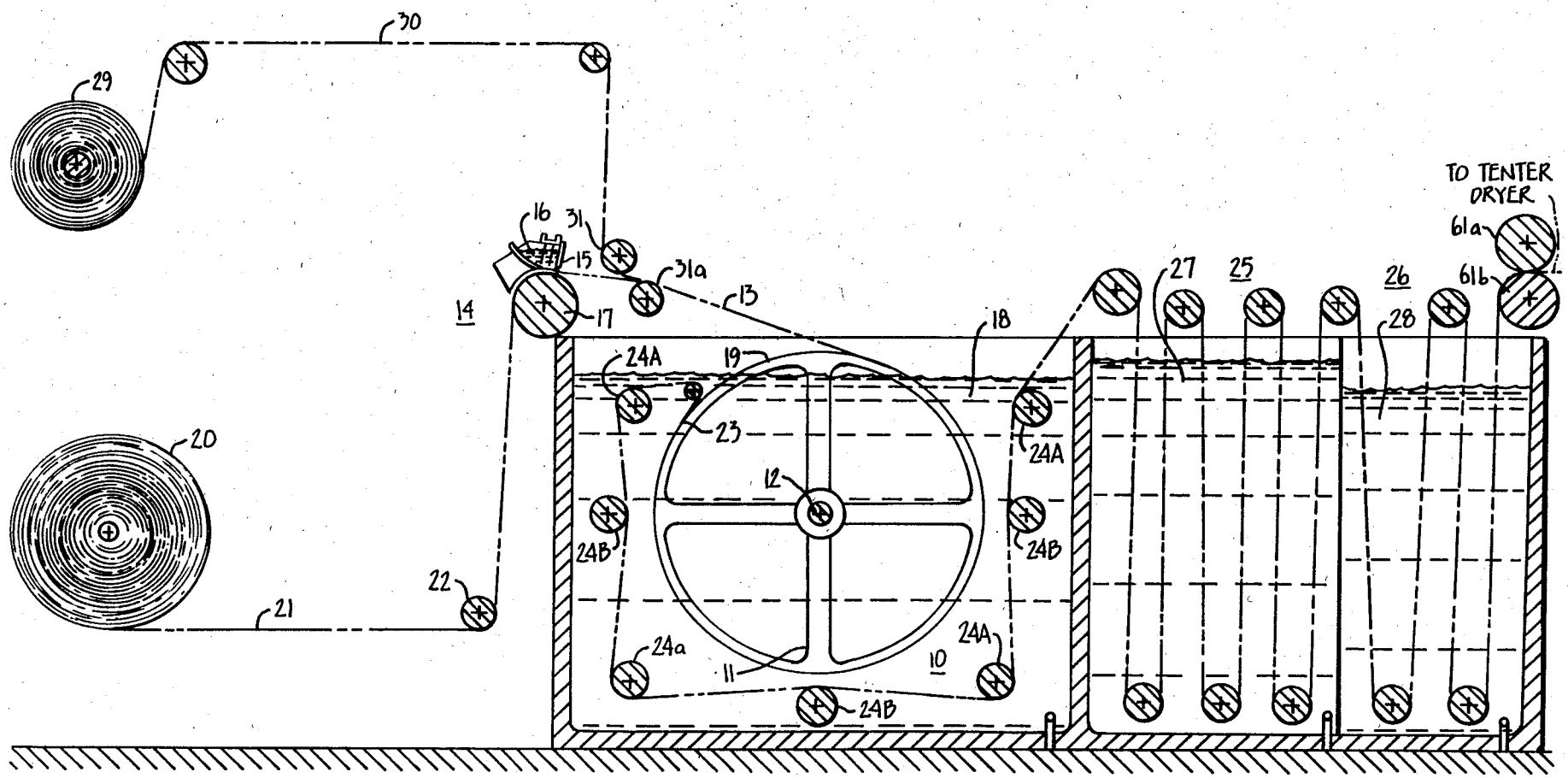
FIG. 1 depicts, schematically, the general nature of the present invention. More specifically, fabric backing 21 is paid-out from roll 20 and provides a backing for the polymeric layer applied at station 14. The shell fabric, such as, for example, nylon taffeta, nylon oxford or nylon rip-stop as well as their polyester counterparts and cotton polyblends, winds about directional roller 22 and enters coating station 14 wherein coating knife 15 applies the polymeric solution stored in reservoir 16 to the surface of the fabric backing.

Ideally, the shell fabric should be clean, dry free of any water repellant treatment and free of impurities prior to being coated in station 14. As an option, the polymer solution coated upon the shell fabric can be contacted with a liner fabric prior to forming the microporous membrane. Liner fabric 30, such as, for example, nylon tricot knit, gaberdine, sharkskin or twill is paid-out from roll 29 and is contacted with polymer solution-coated backing forming a composite member 13 through the action of rollers 31, 31A. If the final fabric is intended to be used as an article of clothing, it is liner fabric 30 which will represent the inner surface of the garment.

Coated fabric 13 is then caused to contact the surface of drum 10 which turns about center axis 12. As such, the coated fabric, grippingly held in contact with surface 19 of drum 10, is immersed within non-solvent bath 18, preferably water. Contact is maintained between composite member 13 and surface 19 until point 23 by which time the microporous membrane has been substantially set or frozen in its sub-microscopically porous configuration. Composite member 13 can then be passed over various processing rollers 24A and 24B. Preferably, rolls 24A are smoothly surfaced to minimize scratching of the newly formed microporous membrane, whereas rolls 24B are scrolled with ridges spiraling outward and down at a speed higher than the speed of the fabric to reduce waves and minimize crease formation. Within bath 18, member 13 is passed through successive non-solvent baths 25 and 26 containing non-solvents 27 and 28—finally emerging and being optionally passed through nip rollers 61A and B to remove residual moisture. As it is the gripping contact between the surface of the drum and the fabric backing that represents the present invention, remaining peripheral equipment such as baths 25 and 26 will not be discussed in great detail. Suffice it to say that any number of baths containing non-solvent 27 and 28, such as water, can be serially appended to the principal bath containing non-solvent 18. It is further noted that coated fabric 13 is shown festooning through baths 25 and 26. This is made possible because (1) the polymeric material has already been substantially totally "set" into a final microporous membrane structure in non-solvent 18 while in contact with the surface 19 and (2) there remains relatively little corrosive solvent in these latter processing stations to interfere with the lubrication of the roller devices necessary in carrying out the festooning operation.

Figure 2:
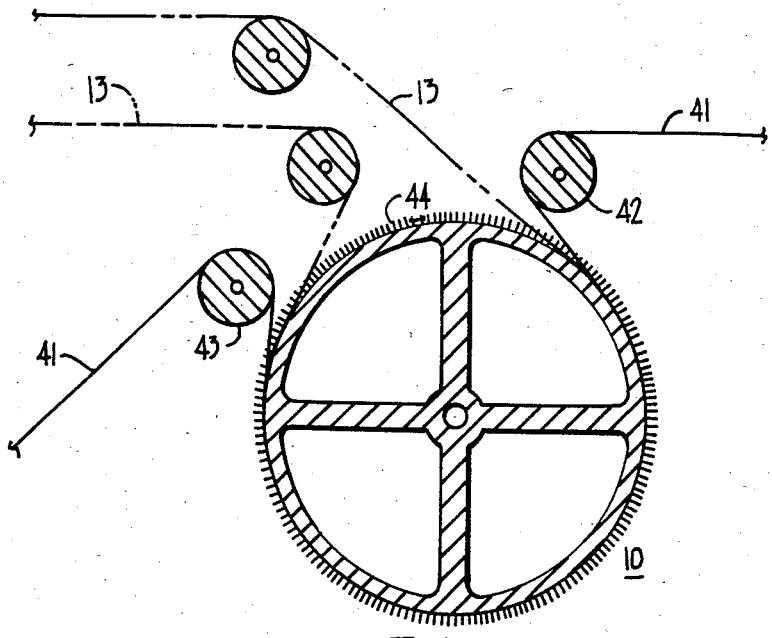

Various embodiments useful in carrying out the present invention are depicted in the remaining figures. Turning to FIG. 2, belt 41 is shown in a path dictated by the relative position of guide rollers 42 and 43 as well as drum 10. Belt 41 is caused to frictionally contact drum 10 over coated fabric 13 in order to maintain the dimensional integrity of the coated backing while the backing is submerged within non-solvent 18.

Figure 3:
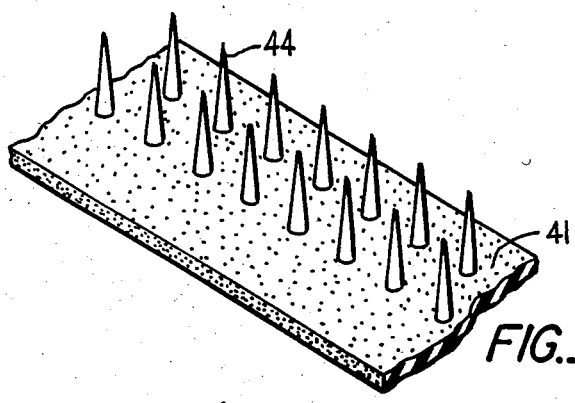

As a further means of maintaining dimensional integrity, the surface 19 of drum 10 can be employed as a support for radially protruding pins. As belt 41 presses composite member 13 against surface 19, said pins 44 greatly aid in gripping the fabric backing 21 thus preventing shrinkage. As an alternative embodiment, conically-shaped pins 44 can be projected from belt 41—see FIG. 3.

When coating backing 21 with polymeric solution 16, it is preferred to only coat interior area 46 leaving salvage edges 45 free of the polymeric material. This facilitates enhanced gripping which, preferably, is restricted to only the salvage edges. This is best seen when viewing FIG. 4 which illustrates yet several other embodiments of the present invention. Rather than employing friction belt 41, bands 47 can be mounted upon the surface of drum 10 having, preferably, radially protruding pins 48 emanating therefrom. The bands, composed of, for example, stainless steel, can be adjustably secured by tightening lug 85 to drum 10 to thus insure gripping engagement only between protruding pins 48 and salvage edges 45.

Figure 4:
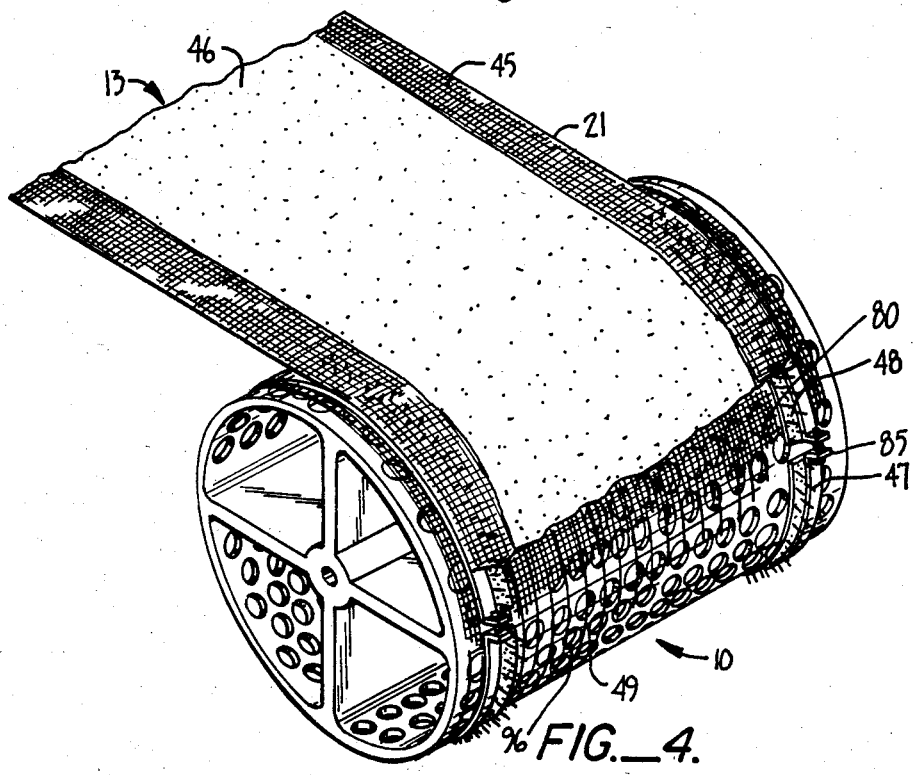
Figure 5:
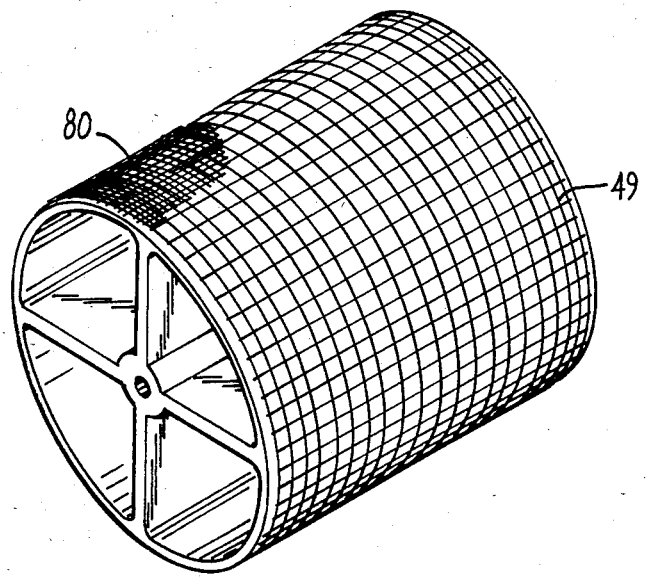
Figure 4A:
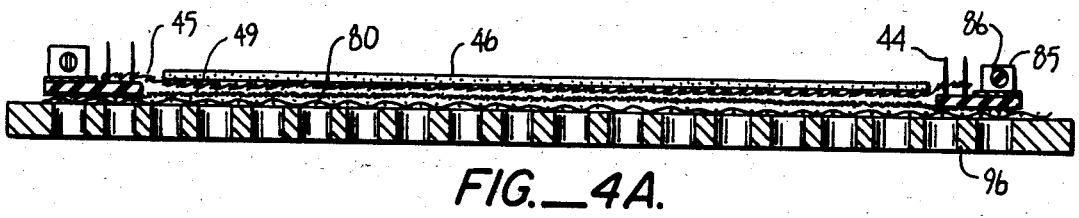

It has been determined that the gripping contact between the surface of the drum and fabric backing 21 can be yet again enhanced by fabricating surface 19 from wire mesh 49. As shown in FIGS. 4 and 4*a*, several layers of wire mesh 49 and 80 can be employed with the finer mesh located on the outer surface of the drum. The wire mesh serves several useful purposes. On the one hand, it provides a coarse surface to increase frictional engagement between fabric backing 21 and drum surface 19. Next, the porous surface made of wire mesh improves non-solvent penetration to the fabric backing which facilitates replacement of the solvent in setting on the microporous membrane structure—particularly when the drum is provided with pores 96. Lastly, the interstices found within the wire act as excellent receiving ports for pins 44 being carried by belt 41 as shown in FIG. 5.

FIGS. 4, 4*a* illustrate yet another preferred embodiment of the present invention. In this instance, drum 95 is configured with a porous surface having openings 96 which facilitates non-solvent contact with composite member 13 simultaneously on both its membrane and fabric sides. This further enhances symmetric membrane formation and reduces the total coagulation time required to solidify the coating. Although not illustrated, the wire mesh, for example, 10 mesh stainless steel covered by 40 mesh stainless steel, as shown in FIG. 5, can be overlayed atop porous drum 95 to improve the gripping surface of the drum while maintaining the porosity of its surface.

Figure 6:
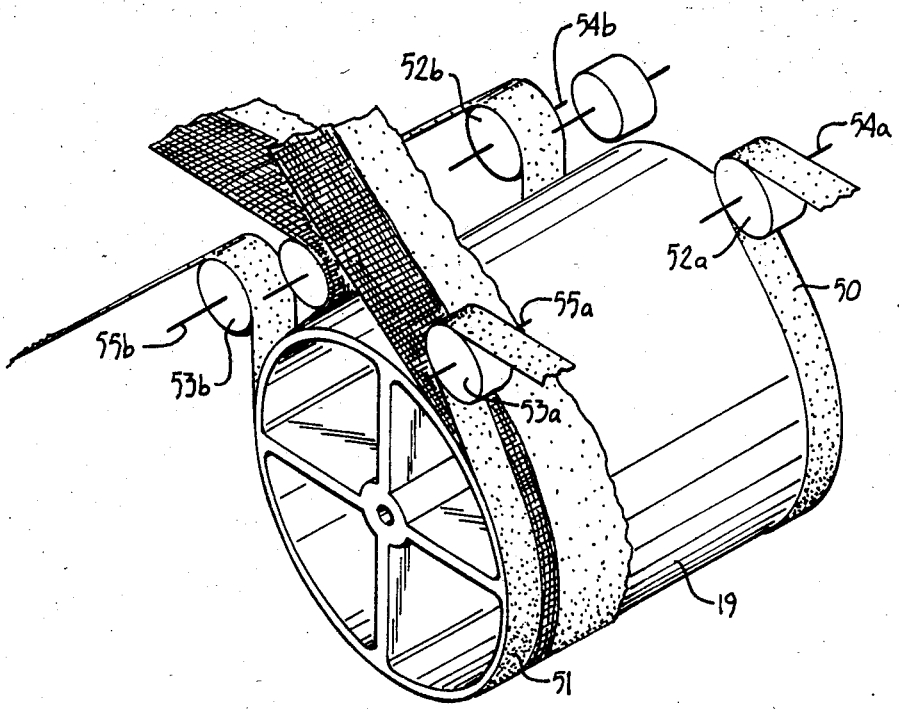

Reference is now made to FIG. 6 which illustrates an embodiment of the present invention which is related to but improved over that embodiment illustrated in FIG. 2. In the latest embodiment, gripping belts 50 and 51 are employed much as gripping belt 41 and are located at the extremities of the longitudinal axis of the cylindrical drum such that belts 50 and 51 are likely to engage only the salvage edges of composite layer 13. In ensuring that this happens, the belts depicted in FIG. 6 are channeled around tension rollers 52A, 52B, 53A and 53B which are each slidably adjustable along axis 54A, 54B, 55A and 55B.

It was found that the vast majority of dimensional shrinkage occurs in the early stages of replacement of the solvent by the non-solvent, for example, the replacement of dimethylacetamide by water. Thus, composite member 13 is contacted with surface 19 of drum 10 and held by gripping means described above to surface 19 from a point prior to contact of the polymer-coated fabric shell to the non-solvent to a point where drum 10 has made an almost complete revolution at which time the composite member is lifted from the drum at 23. The drum speed, coating thickness, temperature and other parameters are coordinated such that when composite member 13 is lifted from the drum, the microporous membrane is "set" so that curling is not likely to occur later in the process. Although the "setting" time varies with coating thickness and temperature conditions, it can generally be stated that for membrane coatings between approximately 1 to 3 mils in thickness, the membrane should be kept in gripping contact with the drum for approximately 4 to 20 seconds. If, for example, a drum is employed having a diameter of 6 feet, the drum should rotate at a speed of approximately 3 to 15 RPM resulting in a linear fabric speed of approximately 56.5′ to 282.6′ per minute.

It has also been found to be advantageous to circulate or agitate the non-solvent bath to reduce the solvent gradient proximate the membrane surface. To some degree, agitation is accomplished by mere drum rotation but other agitating as well as circulating means can be employed, while remaining with the scope of the claimed invention.

It is recognized herein that in producing a flexible layered article where one of the layers is a microporous membrane produced by the "solvent-non-solvent" process, the composite member has a tendency to curl when th epolymeric layer is exposed to the non-solvent. This tendency to curl persists and even increases after the composite member is dried. Thus, unless such precautions as taught herein are taken, a continuous process for making such a flexible layered article would result in a non-planar structure wherein the microporous membrane possesses a concave topography—a result which substantially reduces the value of the layered article commercially. Although U.S. Pat. No. 3,642,668 inferentially discloses producing a microporous membrane on a rotating drum, there remains no teaching in the art for carrying out a process which substantially eliminates the detrimental effects of the microporous membrane's natural tendency to shrink and curl. This can only be done by providing not only a rotating drum but also gripping means associated therewith for physically preventing membrane shrinkage during non-solvent contact. The reference further fails to disclose the preferred embodiment of a perforated drum surface—provided so that the non-solvent can contact both sides of the coated fabric simultaneously.

I claim:

1. A device for producing a flexible layered article comprising:

A. means for paying out a fabric backing;

B. means for coating upon said fabric backing a solution of a polymeric material dissolved in a solvent;

C. a bath containing a liquid which is miscible with the solvent but which is a non-solvent for the polymeric material;

D. drum means which is substantially submerged within said liquid in said bath; and E. gripping means for preventing significant dimensional shrinkage of the coated fabric backing when said coated fabric backing is in contact with the curved surface of the drum.

2. The device of claim 1 wherein said coated fabric is withdrawn from said drum and passed over one or more idler rollers while being substantially submerged in said liquid until substantially all of the solvent has been removed from the polymeric material.

3. The device of claim 1 wherein said gripping means comprises pins embedded in the surface of said drum projecting substantially radially therefrom.

4. The device of claim 3 wherein said pins are located substantially only in those areas of the drum intended to contact salvage edges of the fabric backing.

5. The device of claim 4 wherein said pins are located on bands which are located upon the circumference of the drum and tightened thereupon.

6. The device of claim 5 wherein said bands are adjustable to vary the location of said pins to contact only salvage edges of the fabric backing.

7. The device of claim 1 wherein said gripping means comprises two or more belts which are caused to frictionally engage said fabric backing substantially while said backing is in contact with said drum.

8. The device of claim 7 wherein said two or more belts have embedded therein pins extending substantially radially inward toward the center of said drum when said belts frictionally engage said fabric backing.

9. The device of claim 7 wherein said belts are located as to contact only salvage edges of the fabric backing.

10. The device of claim 1 wherein the curved surface of the drum comprises one or more layers of wire mesh.

11. The device of claim 10 wherein the wire is of finer mesh as each layer extends radially outwardly from the center of the drum.

12. The device of claim 8 wherein the curved surface of the drum comprises one or more layers of wire mesh, such that said pins are caused to extend through openings in the wire mesh when said belts are frictionally engaging said fabric backing.

13. The device of claim 1 wherein the curved surface of the drum is porous.

14. The device of claim 13 wherein the curved surface of the drum supports one or more layers of wire mesh.

* * * * *